US010234233B1

(12) United States Patent
Spikes et al.

(10) Patent No.: US 10,234,233 B1
(45) Date of Patent: Mar. 19, 2019

(54) TOY WATER GUN HAVING ILLUMINABLE WATER TRAJECTORY AND ASSOCIATED USE THEREOF

(71) Applicants: Donna Alexandra Spikes, Jacksonville, FL (US); Charles Brian Spikes, Jacksonville, FL (US)

(72) Inventors: Donna Alexandra Spikes, Jacksonville, FL (US); Charles Brian Spikes, Jacksonville, FL (US)

(73) Assignee: PUMPONATOR FUN, INC., Jacksonville, FL (US)

( * ) Notice: Subject to any disclaimer, the term of this patent is extended or adjusted under 35 U.S.C. 154(b) by 0 days.

(21) Appl. No.: 15/904,343

(22) Filed: Feb. 24, 2018

(51) Int. Cl.
*A63B 67/00* (2006.01)
*F41B 9/00* (2006.01)
*F21L 4/04* (2006.01)

(52) U.S. Cl.
CPC ..... *F41B 9/0006* (2013.01); *F21L 4/04* (2013.01)

(58) Field of Classification Search
CPC ..... A63B 67/00
USPC ..... 273/349
See application file for complete search history.

(56) References Cited

U.S. PATENT DOCUMENTS 4,239,129 A * 12/1980 Esposito ..... A63H 33/36 222/79
5,303,848 A * 4/1994 D'Andrade ..... F41B 9/0018 222/397
5,598,950 A * 2/1997 Liu ..... F41B 9/0018 222/146.6
6,048,280 A * 4/2000 Palmer ..... F41B 11/57 124/1
6,422,566 B1 * 7/2002 Rudell ..... A63F 9/02 273/349
6,474,507 B1 * 11/2002 Hornsby ..... F41B 9/0018 222/113
6,715,763 B2 * 4/2004 Rudell ..... A63F 9/02 273/349
6,892,902 B2 * 5/2005 Hornsby ..... F41B 9/0018 222/175
7,032,837 B2 * 4/2006 Eddins ..... B05B 3/02 222/1
2002/0020712 A1 * 2/2002 Hornsby ..... F41B 9/0018 222/79
2002/0109299 A1 * 8/2002 Rudell ..... A63F 9/02 273/349

(Continued)

*Primary Examiner* — John E Simms, Jr.
*Assistant Examiner* — Dolores Collins
(74) *Attorney, Agent, or Firm* — Ashkan Najafi

(57) ABSTRACT

A toy water gun includes a hand-held body having a water reservoir capable of storing a predetermined quantity of water therein, and a guide rail engaged with the water reservoir. The toy water gun further includes a hand-operated pump mechanism is in fluid communication with the water reservoir and dynamically engaged with the guide rail, a discharge nozzle in fluid communication with the water reservoir and having an illuminable water trajectory selectively egressed distally away therefrom, and a light emitting mechanism attached to a dynamic portion of the pump mechanism. Advantageously, the dynamic portion of the pump mechanism and the light emitting source are contemporaneously reciprocated along a bi-directional travel path relative to a position of the discharge nozzle and thereby illuminate the illuminable water trajectory after being egressed from the discharge nozzle.

18 Claims, 8 Drawing Sheets

(56) References Cited

U.S. PATENT DOCUMENTS

| | | | | |
|---|---|---|---|---|
| 2003/0178439 | A1* | 9/2003 | Hornsby | F41B 9/0018 222/79 |
| 2005/0173559 | A1* | 8/2005 | Eddins | B05B 3/02 239/302 |
| 2010/0285721 | A1* | 11/2010 | Ma | F42B 8/12 446/485 |

* cited by examiner

TOY WATER GUN HAVING ILLUMINABLE WATER TRAJECTORY AND ASSOCIATED USE THEREOF

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to toy water guns and, more particularly, to a toy water gun having an illuminable water trajectory that remains illuminated a longer distance after egressing from the toy water gun.

Prior Art

Water guns or squirters or projectors are common toys, especially for the summer. Children, and adults alike, enjoy getting splashed with water on a hot summer day. The water exiting or ejecting from such toys are typically safe and harmless because the stream of water is not very powerful.

A typical water gun has a reservoir to store a liquid, usually water, and a mechanism of projecting or ejecting the liquid from the reservoir out of a small opening of a water gun. The ejecting mechanism of most prior art water guns are manually powered: for examples, by the pumping action resulting from actuating a trigger, or the pushing of a plunger decreasing the volume of the reservoir. Conventional toy water guns serve its basic purpose of ejecting water, but otherwise have limited entertaining values because their water trajectory remains illuminated only for a short distance after egressing the toy water gun.

Accordingly, a need remains for a toy water gun in order to overcome at least one aforementioned shortcoming. The exemplary embodiment(s) satisfy such a need by providing a toy water gun having an illuminable water trajectory that is convenient and easy to use, lightweight yet durable in design, versatile in its applications, and designed for providing a water trajectory that remains illuminated a longer distance after egressing from the toy water gun while conserving power during not use.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a toy water gun having an illuminable water trajectory that remains illuminated a longer distance after egressing from the toy water gun. These and other objects, features, and advantages of the non-limiting exemplary embodiment(s) are provided by a toy water gun including a hand-held body having a water reservoir capable of storing a predetermined quantity of water therein, and a guide rail engaged with the water reservoir. The toy water gun further includes a hand-operated pump mechanism is in fluid communication with the water reservoir and dynamically engaged with the guide rail, a discharge nozzle in fluid communication with the water reservoir and having an illuminable water trajectory selectively egressed distally away therefrom, and a light emitting mechanism attached to a dynamic portion of the pump mechanism. Advantageously, the dynamic portion of the pump mechanism and the light emitting source are contemporaneously reciprocated along a bi-directional travel path relative to a position of the discharge nozzle and thereby illuminate the illuminable water trajectory after being egressed from the discharge nozzle.

In a non-limiting exemplary embodiment, the bi-directional travel path includes a first linear path extended distally away from the discharge nozzle, and a second linear path extended proximally back towards the discharge nozzle. Advantageously, the illuminable water trajectory is illuminated after the dynamic portion of the pump mechanism and the light emitting mechanism are linearly displaced along the second linear path and proximally back towards the discharge nozzle.

In a non-limiting exemplary embodiment, the pump mechanism is located at an initial position of the first linear path, defined at an initial reference plane, before the illuminable water trajectory is egressed distally away from the discharge nozzle.

In a non-limiting exemplary embodiment, the pump mechanism is distally extended to a final position of the first linear path and an initial position of the second linear path, defined at a final reference plane, after being linearly displaced a maximum distance away from the initial reference plane.

In a non-limiting exemplary embodiment, the illuminable water trajectory is illuminated and egressed distally away from the discharge nozzle when the pump mechanism is retracted to an intermediate position after being distally extended the maximum distance.

In a non-limiting exemplary embodiment, the pump mechanism is returned back to the initial reference plane after being fully retracted along a proximal direction of the second linear path.

In a non-limiting exemplary embodiment, the light emitting mechanism includes a power source housed within the dynamic portion of the pump mechanism, a switch communicatively coupled to the power source, an illuminable light source communicatively coupled to the switch, and an actuator in selective communication with the switch. Such an actuator is linearly reciprocated along the bi-directional travel path as the pump mechanism is operated such that the actuator automatically toggles the switch between on and off positions when the illuminable water trajectory is initially and completely egressed out from the discharge nozzle, respectively.

In a non-limiting exemplary embodiment, the illuminable light source and the discharge nozzle are substantially coplanar when the pump mechanism is at a fully retracted position.

In a non-limiting exemplary embodiment, the illuminable light source remains at an off position until the pump mechanism reaches a fully extended position disposed at a maximum distance distally away from discharge nozzle. Advantageously, as the pump mechanism is linearly retracted back from the fully extended position and towards an initial retracted position, the light emitting mechanism is automatically toggled to an on position and the illuminable water trajectory is automatically egressed from the discharge nozzle.

The present disclosure further includes a method of utilizing toy water gun. Such a method includes the steps of: providing a hand-held body including a water reservoir capable of storing a predetermined quantity of water therein, and a guide rail engaged with the water reservoir; providing and fluidly communicating a hand-operated pump mechanism with the water reservoir; dynamically engaging the pump mechanism with the guide rail; and providing and fluidly communicating a discharge nozzle with the water reservoir. Such a discharge nozzle has an illuminable water trajectory selectively egressed distally away therefrom.

The method further includes the steps of: providing and attaching a light emitting mechanism to a dynamic portion of the pump mechanism; and contemporaneously reciprocating the dynamic portion of the pump mechanism and the light emitting source along a bi-directional travel path relative to a position of the discharge nozzle and thereby illuminating the illuminable water trajectory after being egressed from the discharge nozzle.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 6:
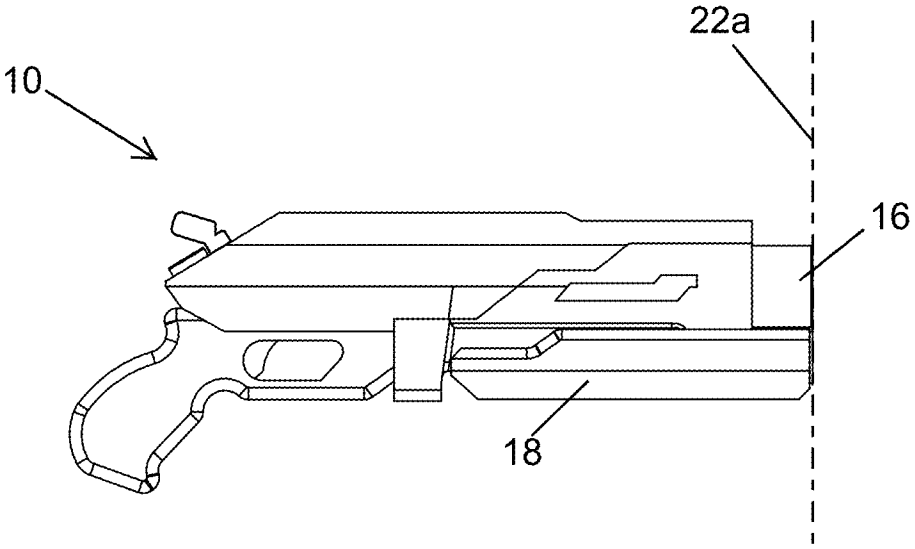
FIG. 6 is a side elevational view of the toy water gun shown in FIG. 1 wherein the pump mechanism is located at an initial position, which defined by an initial reference plane, before the water trajectory egresses distally away from the discharge nozzle.
Figure 6A:
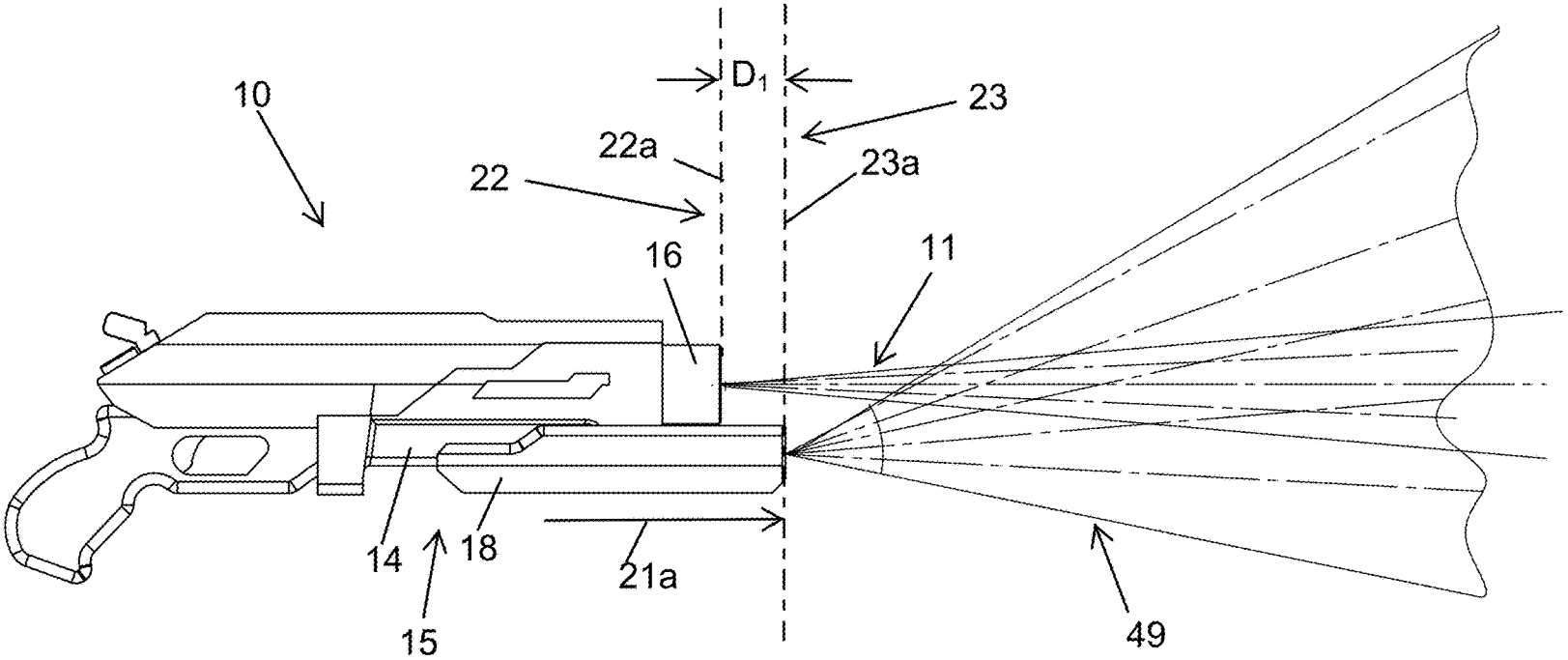
Figure 6B:
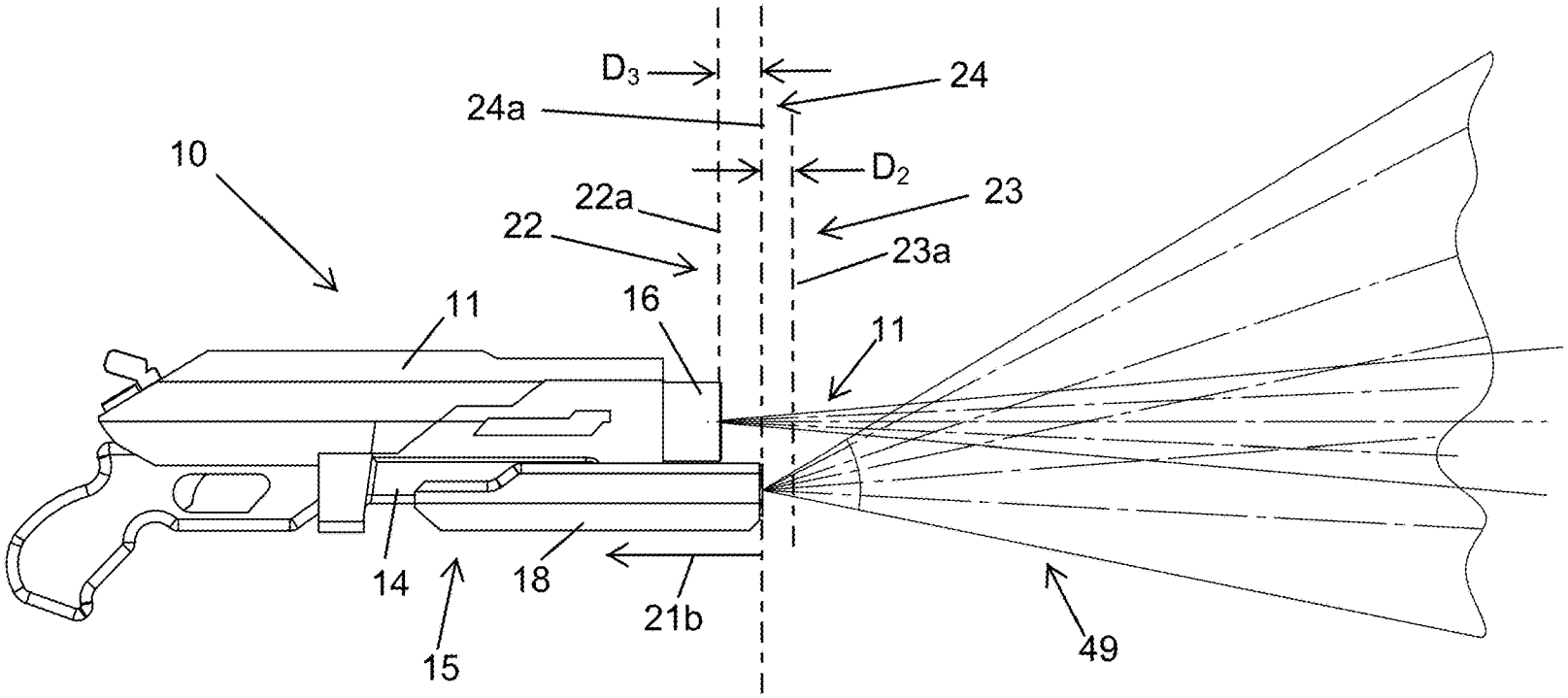
Figure 6C:
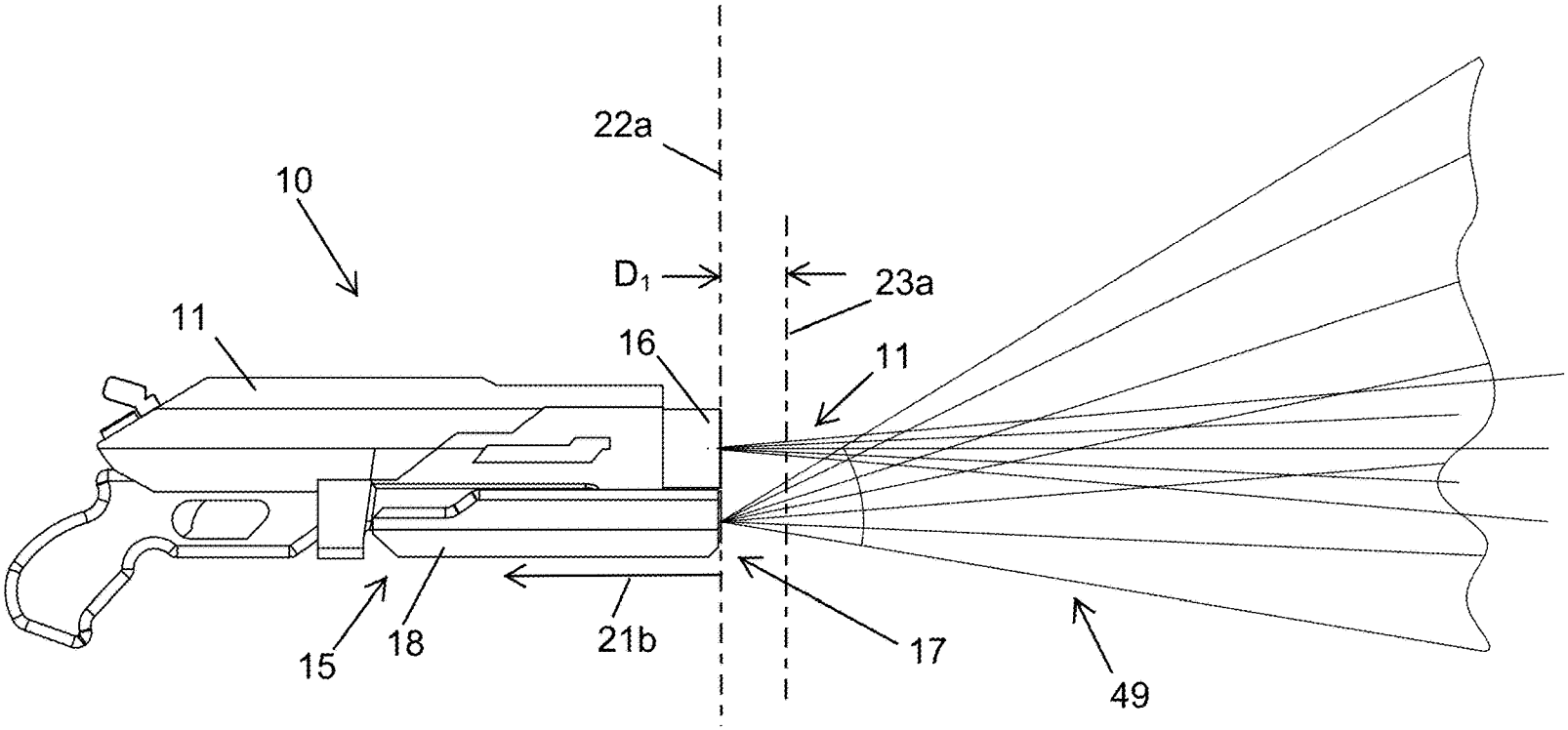
Figure 7:
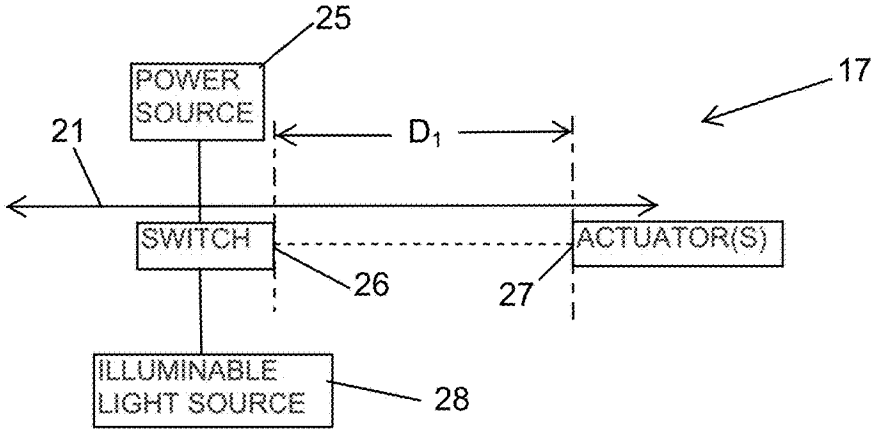
Figure 6D:
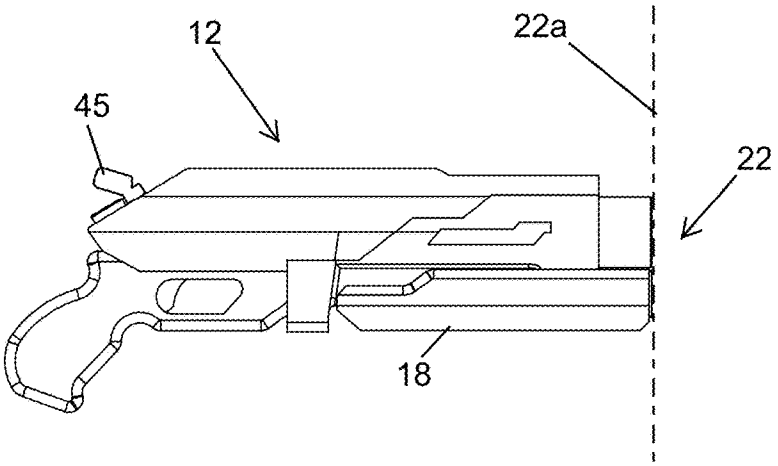

FIG. 6*a* is a side elevational view of the toy water gun shown in FIG. 6 wherein the pump mechanism is located at a final position, after traveling a maximum distance away from the initial position, which is defined by a final reference plane;

FIG. 6*b* a side elevational view of the toy water gun shown in FIG. 6*a* wherein the pump mechanism is located an intermediate position, after partially traveling back towards the initial position, which is located at an intermediate reference plane;

FIG. 6*c* a side elevational view of the toy water gun shown in FIG. 6*b* wherein the pump mechanism is located back at the initial position, after completely traveling back to the initial position, which is located at the initial reference plane;

FIG. 6*d* is a side elevational view of the toy water gun shown in FIG. 6*c* wherein the pump mechanism is returned back to the initial position, which defined by an initial reference plane, after the water trajectory has egressed distally away from the discharge nozzle; and FIG. 7 is a schematic block diagram illustrating the interrelationship between the major electronic components of a light emitting mechanism that illuminates the water trajectory egressed from the discharge nozzle.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

The non-limiting exemplary embodiment(s) is/are referred to generally in FIGS. 1-7 and is/are intended to provide a toy water gun 10 having an illuminable water trajectory 11 that remains illuminated a longer distance after egressing from the toy water gun 10. The toy water gun 10 includes a hand-held body 12 having a water reservoir 13 capable of storing a predetermined quantity of water therein, and a guide rail 14 engaged with the water reservoir 13. An end cap 45 is selectively plugs an inlet of reservoir 13. Such a guide rail 14 may be an integral part of the body 12 or may be a separate component that is detachably affixed to the body 12. For example, the guide rail 14 may include two sleeve portions that are wrapped about an outer surface of body 12. Such sleeve portions can be snapped together or secured by other suitable fasteners to maintain a secure grip about body 12.

The toy water gun 10 further includes a hand-operated pump mechanism 15 is in fluid communication with the water reservoir 13 and dynamically engaged with the guide rail 14, a discharge nozzle 16 in fluid communication with the water reservoir 13 and having an illuminable water trajectory 11 selectively egressed distally away therefrom, and a light emitting mechanism 17 attached to a dynamic portion 18 of the pump mechanism 15. The pump mechanism 15 may be a conventional pump mechanism that operates via a piston and air chamber, for example. Advantageously, the dynamic portion 18 of the pump mechanism 15 and the light emitting mechanism 17 are contemporaneously reciprocated along a bi-directional travel path 21 relative to a position of the discharge nozzle 16 and thereby illuminate the illuminable water trajectory 11 after being egressed from the discharge nozzle 16. Notably, the illuminable light source 28 is activated only when the pump mechanism 15 is retracted proximally back towards the discharge nozzle 16; not during extraction distally away from the discharge nozzle 16. Such a structural configuration saves power and maximizes the length of time during which the illuminable water trajectory 11 is illuminated after leaving the discharge nozzle 16 because the light array emitted from the illuminable light source 28 starts at maximum distance D3 thereby spanning a greater distance than if it started at initial position 22.

In a non-limiting exemplary embodiment, the bi-directional travel path 21 includes a first linear path 21*a* extended distally away from the discharge nozzle 16, and a second linear path 21*b* extended proximally back towards the discharge nozzle 16. Advantageously, the illuminable water trajectory 11 is illuminated after the dynamic portion 18 of the pump mechanism 15 and the light emitting mechanism 17 are linearly displaced along the second linear path 21*b* and proximally back towards the discharge nozzle 16. Such a structural configuration saves power and maximizes the length of time during which the illuminable water trajectory 11 is illuminated after leaving the discharge nozzle 16 because the light array emitted from the illuminable light source 28 starts at maximum distance D3 thereby spanning a greater distance than if it started at initial position 22.

Figure 1:
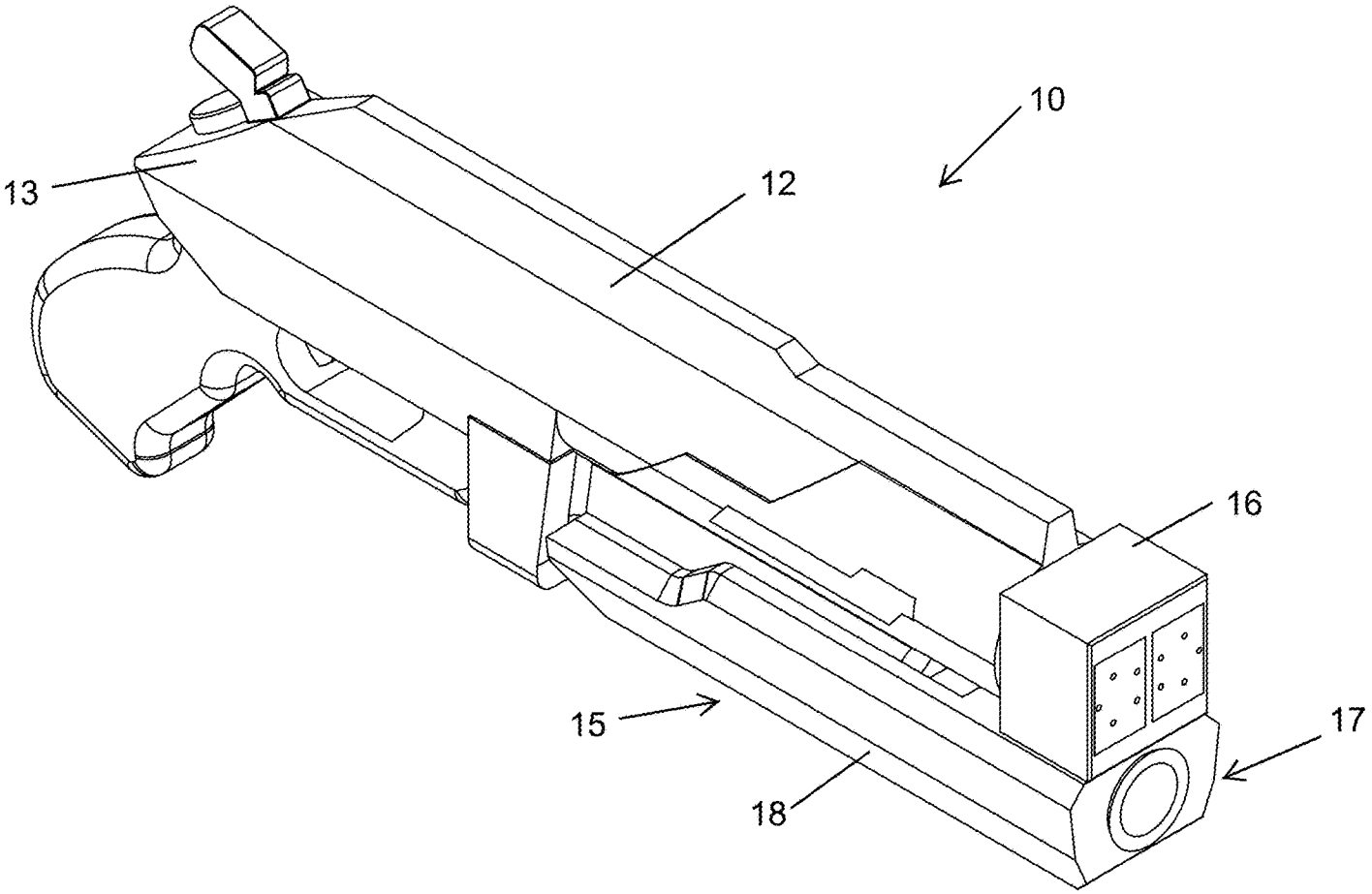
FIG. 1 is a perspective view of a toy water gun having an illuminable water trajectory wherein the pump mechanism is linearly retracted to an initial position, in accordance with a non-limiting exemplary embodiment of the present disclosure.
Figure 2:
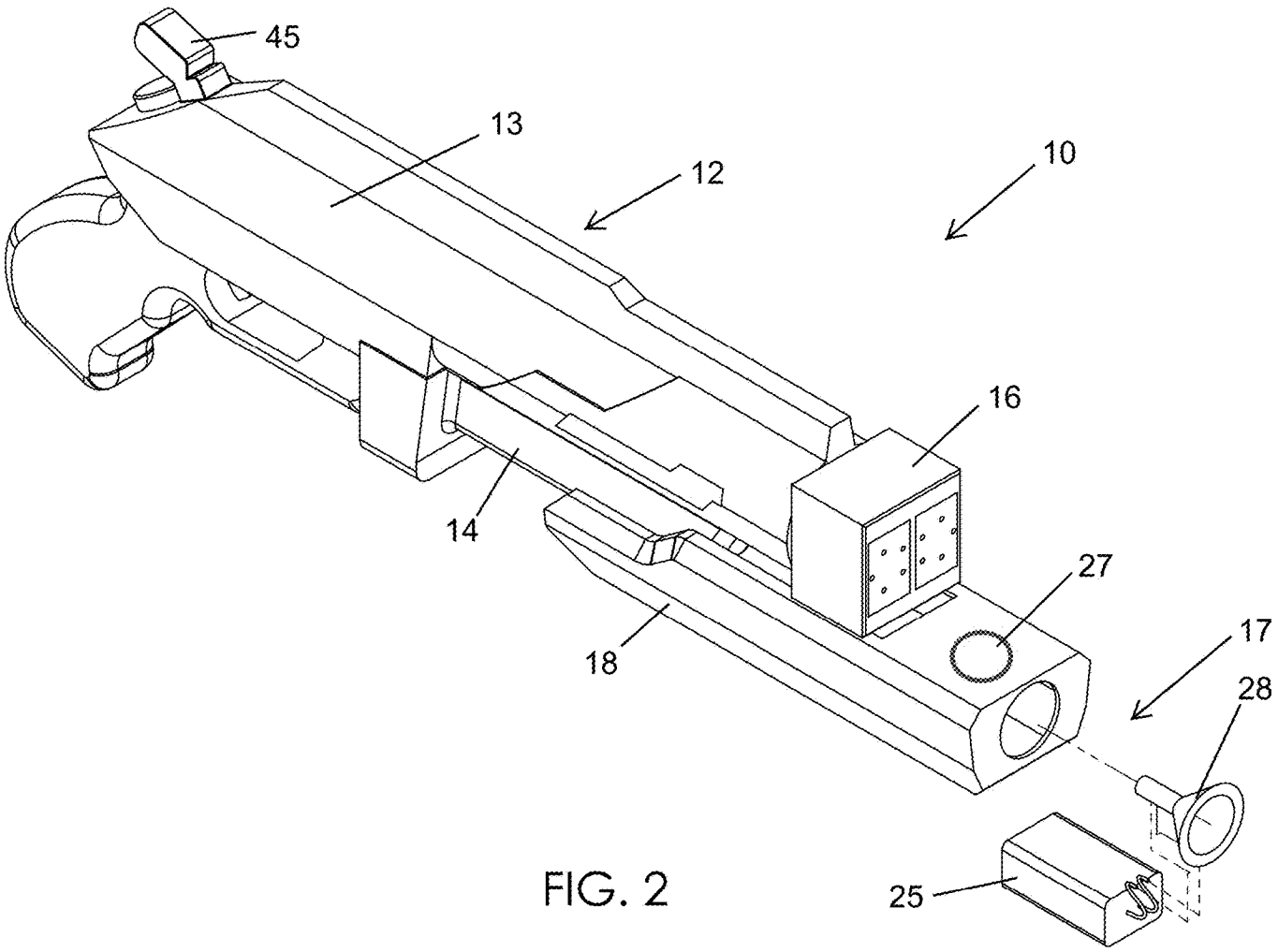
FIG. 2 is an exploded view of the toy water gun shown in FIG. 1.
Figure 3:
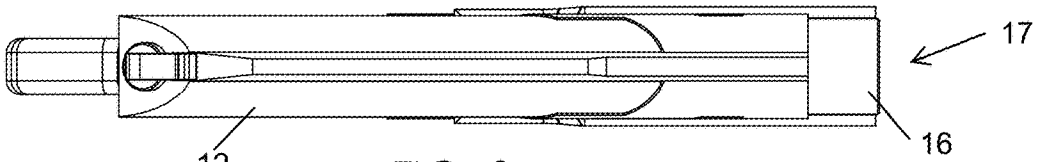
FIG. 3 is a top plan view of the toy water gun shown in FIG. 1.
Figure 4:
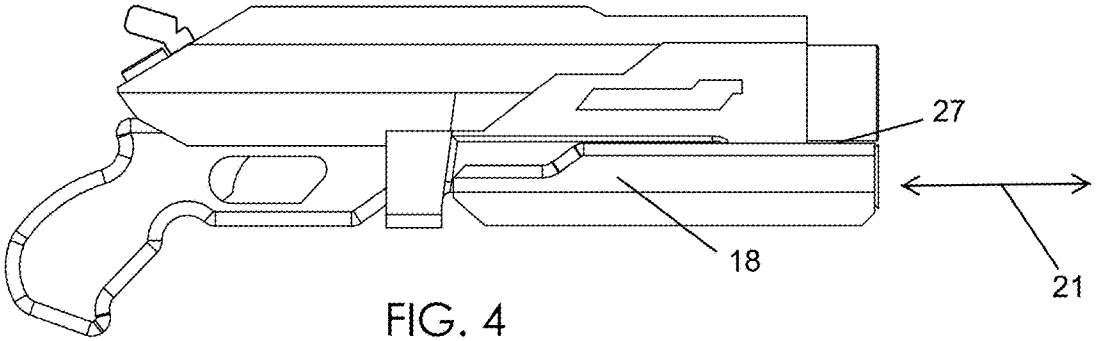
FIG. 4 is a side elevational view of the toy water gun shown in FIG. 1.
Figure 5:
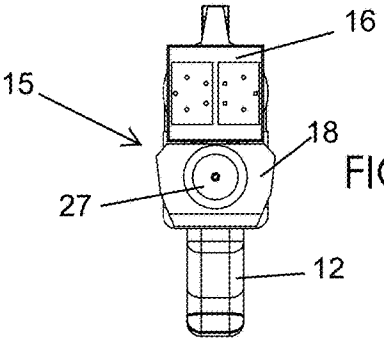
FIG. 5 is a front elevational view of the toy water gun shown in FIG. 1.

FIG. 6 is a side elevational view of the toy water gun 10 shown in FIG. 1 wherein the pump mechanism 15 is located at an initial position 22, which defined by an initial reference plane 22*a*, before the water trajectory 11 egresses distally away from the discharge nozzle 16. In a non-limiting exemplary embodiment, the pump mechanism 15 is located at an initial position 22 of the first linear path 21*a*, defined at an initial reference plane 22*a*, before the illuminable water trajectory 11 is egressed distally away from the discharge nozzle 16. Such a structural configuration saves power and maximizes the length of time during which the illuminable water trajectory 11 is illuminated after leaving the discharge nozzle 16 because the light array emitted from the illuminable light source 28 starts at maximum distance D3 thereby spanning a greater distance than if it started at initial position 22.

FIG. 6*a* is a side elevational view of the toy water gun 10 shown in FIG. 6 wherein the pump mechanism 15 is located at a final position 23, after traveling a maximum distance away from the initial position 22, which is defined by a final reference plane 23*a*. Notably, the illuminable light source 28 is activated only when the pump mechanism 15 is retracted proximally back towards the discharge nozzle 16; not during extraction distally away from the discharge nozzle 16. Such a structural configuration saves power and maximizes the length of time during which the illuminable water trajectory 11 is illuminated after leaving the discharge nozzle 16 because the light array emitted from the illuminable light source 28 starts at maximum distance D3 thereby spanning a greater distance than if it started at initial position 22.

In a non-limiting exemplary embodiment, the pump mechanism 15 is distally extended to a final position 23 of the first linear path 21*a* and an initial position 22 of the second linear path 21*b*, defined at a final reference plane 23*a*, after being linearly displaced a maximum distance away from the initial reference plane 22*a*. FIG. 6*c* a side elevational view of the toy water gun 10 shown in FIG. 6*b* wherein the pump mechanism 15 is located back at the initial position 22, after completely traveling back to the initial position 22, which is located at the initial reference plane 22*a*. Notably, the illuminable light source 28 is activated only when the pump mechanism 15 is retracted proximally back towards the discharge nozzle 16; not during extraction distally away from the discharge nozzle 16. Such a structural configuration saves power and maximizes the length of time during which the illuminable water trajectory 11 is illuminated after leaving the discharge nozzle 16 because the light array emitted from the illuminable light source 28 starts at maximum distance D3 thereby spanning a greater distance than if it started at initial position 22.

In a non-limiting exemplary embodiment, the illuminable water trajectory 11 is illuminated and egressed distally away from the discharge nozzle 16 when the pump mechanism 15 is retracted to an intermediate position 24 after being distally extended the maximum distance. FIG. 6*b* a side elevational view of the toy water gun 10 shown in FIG. 6*a* wherein the pump mechanism 15 is located an intermediate position 24, after partially traveling back towards the initial position 22, which is located at an intermediate reference plane 24*a*. Such a structural configuration saves power and maximizes the length of time during which the illuminable water trajectory 11 is illuminated after leaving the discharge nozzle 16 because the light array emitted from the illuminable light source 28 starts at maximum distance D3 thereby spanning a greater distance than if it started at initial position 22.

In a non-limiting exemplary embodiment, the pump mechanism 15 is returned back to the initial reference plane 22*a* after being fully retracted along a proximal direction of the second linear path 21*b*. FIG. 6*d* is a side elevational view of the toy water gun 10 shown in FIG. 6*c* wherein the pump mechanism 15 is returned back to the initial position 22, which defined by an initial reference plane 22*a*, after the water trajectory 11 has egressed distally away from the discharge nozzle 16. FIG. 7 is a schematic block diagram illustrating the interrelationship between the major electronic components of a light emitting mechanism 17 that illuminates the water trajectory 11 egressed from the discharge nozzle 16. Such a structural configuration saves power and maximizes the length of time during which the illuminable water trajectory 11 is illuminated after leaving the discharge nozzle 16 because the light array emitted from the illuminable light source 28 starts at maximum distance D3 thereby spanning a greater distance than if it started at initial position 22.

In a non-limiting exemplary embodiment, the light emitting mechanism 17 includes a power source 25 housed within the dynamic portion 18 of the pump mechanism 15, a switch 26 communicatively coupled to the power source 25 and preferably located at a bottom surface of discharge nozzle 16, an illuminable light source 28 communicatively coupled to the switch 26, and an actuator 27 in selective communication with the switch 26. Such an actuator 27 is linearly reciprocated along the bi-directional travel path 21 as the pump mechanism 15 is operated such that the actuator 27 automatically toggles the switch 26 between on and off positions when the illuminable water trajectory 11 is initially and completely egressed out from the discharge nozzle 16, respectively. Such a structural configuration saves power and maximizes the length of time during which the illuminable water trajectory 11 is illuminated after leaving the discharge nozzle 16 because the light array emitted from the illuminable light source 28 starts at maximum distance D3 thereby spanning a greater distance than if it started at initial position 22.

Referring to FIGS. 6-6*d*, the light emitting mechanism 17 is activated after the dynamic portion 18 of pump mechanism 15 is extracted to a fully extended position such that a maximum distance D1 exists between the discharge nozzle 16 and the illuminable light source 28. As the dynamic portion 18 is retracted, the illuminable light source 28 moves closer to the discharge nozzle (e.g., distance D2 is approximately midway back from final position 23, and distance D3 is approximately midway back to initial position 22), the illuminable light source 28 remains activated until the dynamic portion 18 returns to initial position 22 wherein the illuminable light source 28 turns off. Such a structural configuration saves power and maximizes the length of time during which the illuminable water trajectory 11 is illuminated after leaving the discharge nozzle 16 because the light array emitted from the illuminable light source 28 starts at maximum distance D3 thereby spanning a greater distance than if it started at initial position 22.

In a non-limiting exemplary embodiment, the switch 26 may be a multi-pole switch 26 and the actuator 27 may be one or more mechanical fingers or other suitable mechanical projections that engage the multi-pole switch 26 as the dynamic portion 18 of the pump mechanism 15 linearly reciprocates to selectively discharge the illuminable water trajectory 11. In particular, the actuator 27 may include a first actuator is positioned at a distal end of the dynamic portion 18, and a second actuator is positioned at a proximal end of the dynamic portion 18. As the dynamic portion 18 is extracted from the initial position 22 (the switch 26 is at a first off position), the first actuator distally toggles the switch 26 to a second off position. When the dynamic portion 18 is extracted to a fully extended position (final position 23), the second actuator distally toggles the switch 26 to an on position, which activates the illuminable light source 28. As the dynamic portion 18 is retracted (illuminable water trajectory 11 begins egress out from discharge nozzle 16), the second actuator proximally toggles the switch 26 to the second off position (which turns off the illuminable light source 28). When the dynamic portion 18 is returned to the initial position 22 (illuminable water trajectory 11 completes egress out from discharge nozzle 16), the second actuator toggles (resets) the switch 26 to the first off position (illuminable light source 28 remains off). Notably, the illuminable light source 28 is activated only when the pump mechanism 15 is retracted proximally back towards the discharge nozzle 16; not during extraction distally away from the discharge nozzle 16. Such a structural configuration saves power by selectively activating the illuminable light source 28 only during egress of the illuminable water trajectory 11 out from the discharge nozzle 16). And it maximizes the length of time during which the illuminable water trajectory 11 is illuminated after leaving the discharge nozzle 16.

In a non-limiting exemplary embodiment, the illuminable light source 28 may be manually toggled and is not dependent on linear reciprocation of the dynamic portion 18 of pump mechanism 15. In such an embodiment, the switch 26 is preferably located at a conspicuous location at an exterior surface of body 12.

In a non-limiting exemplary embodiment, the switch 26 may be a magnetically activated switch 26 and the actuator 27 may include first and second magnets. Similar to the previous embodiment hereinabove, after the first and second magnets motion past the switch 26 in a distal direction (dynamic portion 18 extracted), the illuminable light source 28 turns on. Conversely, after the first and second magnets motion past the switch 26 in a proximal direction (dynamic portion 18 retracted), the illuminable light source 28 turns off.

In a non-limiting exemplary embodiment, the switch 26 may include a motion sensor and the actuator 27 may include first and second objects detectable by the motion sensor. Similar to the previous embodiment hereinabove, after the first and second objects slide past the switch 26 in a distal direction (dynamic portion 18 extracted), the illuminable light source 28 turns on. Conversely, after the first and second objects slide past the switch 26 in a proximal direction (dynamic portion 18 retracted), the illuminable light source 28 turns off.

In a non-limiting exemplary embodiment, the illuminable light source 28 and the discharge nozzle 16 are substantially coplanar when the pump mechanism 15 is at a fully retracted position (initial position 22).

In a non-limiting exemplary embodiment, the illuminable light source 28 remains at an off position until the pump mechanism 15 reaches a fully extended position disposed at a maximum distance (final position 23) distally away from discharge nozzle 16. Advantageously, as the pump mechanism 15 is linearly retracted back from the fully extended position (final position 23) and towards an initial retracted position (initial position 22), the light emitting mechanism 17 is automatically toggled to an on position and the illuminable water trajectory 11 is automatically egressed from the discharge nozzle 16.

The present disclosure further includes a method of utilizing toy water gun 10. Such a method includes the steps of: providing a hand-held body 12 including a water reservoir 13 capable of storing a predetermined quantity of water therein, and a guide rail 14 engaged with the water reservoir 13; providing and fluidly communicating a hand-operated pump mechanism 15 with the water reservoir 13; dynamically engaging the pump mechanism 15 with the guide rail 14; and providing and fluidly communicating a discharge nozzle 16 with the water reservoir 13. Such a discharge nozzle 16 has an illuminable water trajectory 11 selectively egressed distally away therefrom.

The method further includes the steps of: providing and attaching a light emitting mechanism 17 to a dynamic portion 18 of the pump mechanism 15; and contemporaneously reciprocating the dynamic portion 18 of the pump mechanism 15 and the light emitting mechanism 17 along a bi-directional travel path 21 relative to a position of the discharge nozzle 16 and thereby illuminating the illuminable water trajectory 11 after being egressed from the discharge nozzle 16.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A toy water gun comprising: a body including a water reservoir capable of storing a predetermined quantity of water therein, and a guide rail engaged with said water reservoir; a pump mechanism in fluid communication with said water reservoir and dynamically engaged with said guide rail; a discharge nozzle in fluid communication with said water reservoir and having an illuminable water trajectory selectively egressed distally away therefrom; and a light emitting source mechanism attached to a dynamic portion of said pump mechanism; wherein said illuminable light source is configured to remain at an off position until said pump mechanism reaches a fully extended position disposed at a maximum distance distally away from discharge nozzle; wherein, as said pump mechanism is configured to linearly retract back from said fully extended position and towards an initial retracted position, said light emitting mechanism is configured to automatically toggle to an on position and said illuminable water trajectory is configured to automatically egress from said discharge nozzle; wherein said dynamic portion of said pump mechanism and said light emitting source are contemporaneously reciprocated along a bi-directional travel path relative to a position of said discharge nozzle and thereby illuminate said illuminable water trajectory after being egressed from said discharge nozzle.

2. The toy water gun of claim 1, wherein said bi-directional travel path comprises:

a first linear path extended distally away from said discharge nozzle; and a second linear path extended proximally back towards said discharge nozzle;

wherein said illuminable water trajectory is illuminated after said dynamic portion of said pump mechanism and said light emitting mechanism are linearly displaced along said second linear path and proximally back towards said discharge nozzle.

3. The toy water gun of claim 2, wherein said pump mechanism is located at an initial position of said first linear path, defined at an initial reference plane, before said illuminable water trajectory is egressed distally away from said discharge nozzle.

4. The toy water gun of claim 3, wherein said pump mechanism is distally extended to a final position of said first linear path and an initial position of said second linear path, defined at a final reference plane, after being linearly displaced a maximum distance away from said initial reference plane.

5. The toy water gun of claim 4, wherein said illuminable water trajectory is illuminated and egressed distally away from said discharge nozzle when said pump mechanism is retracted to an intermediate position after being distally extended said maximum distance.

6. The toy water gun of claim 5, wherein said pump mechanism is returned back to said initial reference plane after being fully retracted along a proximal direction of said second linear path.

7. The toy water gun of claim 1, wherein said light emitting mechanism comprises:

a power source housed within said dynamic portion of said pump mechanism;

a switch communicatively coupled to said power source;

an illuminable light source communicatively coupled to said switch; and an actuator in selective communication with said switch, said actuator being linearly reciprocated along said bi-directional travel path as said pump mechanism is operated such that said actuator automatically toggles said switch between on and off positions when said illuminable water trajectory is initially and completely egressed out from said discharge nozzle, respectively.

8. The toy water gun of claim 1, wherein said illuminable light source and said discharge nozzle are substantially coplanar when said pump mechanism is at a fully retracted position.

9. A toy water gun comprising: a hand-held body including a water reservoir capable of storing a predetermined quantity of water therein, and a guide rail engaged with said water reservoir; a hand-operated pump mechanism in fluid communication with said water reservoir and dynamically engaged with said guide rail; a discharge nozzle in fluid communication with said water reservoir and having an illuminable water trajectory selectively egressed distally away therefrom; and a light emitting source mechanism attached to a dynamic portion of said pump mechanism; wherein said illuminable light source is configured to remain at an off position until said pump mechanism reaches a fully extended position disposed at a maximum distance distally away from discharge nozzle; wherein, as said pump mechanism is configured to linearly retract back from said fully extended position and towards an initial retracted position, said light emitting mechanism is configured to automatically toggle to an on position and said illuminable water trajectory is configured to automatically egress from said discharge nozzle; wherein said dynamic portion of said pump mechanism and said light emitting source are contemporaneously reciprocated along a bi-directional travel path relative to a position of said discharge nozzle and thereby illuminate said illuminable water trajectory after being egressed from said discharge nozzle.

10. The toy water gun of claim 9, wherein said bi-directional travel path comprises:

a first linear path extended distally away from said discharge nozzle; and a second linear path extended proximally back towards said discharge nozzle;

wherein said illuminable water trajectory is illuminated after said dynamic portion of said pump mechanism and said light emitting mechanism are linearly displaced along said second linear path and proximally back towards said discharge nozzle.

11. The toy water gun of claim 10, wherein said pump mechanism is located at an initial position of said first linear path, defined at an initial reference plane, before said illuminable water trajectory is egressed distally away from said discharge nozzle.

12. The toy water gun of claim 11, wherein said pump mechanism is distally extended to a final position of said first linear path and an initial position of said second linear path, defined at a final reference plane, after being linearly displaced a maximum distance away from said initial reference plane.

13. The toy water gun of claim 12, wherein said illuminable water trajectory is illuminated and egressed distally away from said discharge nozzle when said pump mechanism is retracted to an intermediate position after being distally extended said maximum distance.

14. The toy water gun of claim 13, wherein said pump mechanism is returned back to said initial reference plane after being fully retracted along a proximal direction of said second linear path.

15. The toy water gun of claim 9, wherein said light emitting mechanism comprises:

a power source housed within said dynamic portion of said pump mechanism;

a switch communicatively coupled to said power source;

an illuminable light source communicatively coupled to said switch; and an actuator in selective communication with said switch, said actuator being linearly reciprocated along said bi-directional travel path as said pump mechanism is operated such that said actuator automatically toggles said switch between on and off positions when said illuminable water trajectory is initially and completely egressed out from said discharge nozzle, respectively.

16. The toy water gun of claim 9, wherein said illuminable light source and said discharge nozzle are substantially coplanar when said pump mechanism is at a fully retracted position.

17. The toy water gun of claim 9, wherein said illuminable light source remains at an off position until said pump mechanism reaches a fully extended position disposed at a maximum distance distally away from discharge nozzle;

wherein, as said pump mechanism is linearly retracted back from said fully extended position and towards an initial retracted position, said light emitting mechanism is automatically toggled to an on position and said illuminable water trajectory is automatically egressed from said discharge nozzle.

18. A method of utilizing toy water gun, comprising the steps of: providing a hand-held body including a water reservoir capable of storing a predetermined quantity of water therein, and a guide rail engaged with said water reservoir; providing and fluidly communicating a hand-operated pump mechanism with said water reservoir; dynamically engaging said pump mechanism with said guide rail; providing and fluidly communicating a discharge nozzle with said water reservoir; said discharge nozzle having an illuminable water trajectory selectively egressed distally away therefrom; providing and attaching a light emitting source mechanism to a dynamic portion of said pump mechanism; wherein said illuminable light source is configured to remain at an off position until said pump mechanism reaches a fully extended position disposed at a maximum distance distally away from discharge nozzle; wherein, as said pump mechanism is configured to linearly retract back from said fully extended position and towards an initial retracted position, said light emitting mechanism is configured to automatically toggle to an on position and said illuminable water trajectory is configured to automatically egress from said discharge nozzle; and contemporaneously reciprocating said dynamic portion of said pump mechanism and said light emitting source along a bi-directional travel path relative to a position of said discharge nozzle and thereby illuminating said illuminable water trajectory after being egressed from said discharge nozzle.

* * * * *